US006502290B1

(12) United States Patent
Tseng

(10) Patent No.: US 6,502,290 B1
(45) Date of Patent: Jan. 7, 2003

(54) HOOK TAPE FABRICATION METHOD

(75) Inventor: Tony Tseng, Chang Hua Tsien (TW)

(73) Assignee: Taiwan Paiho Limited, Chang Hua Tsien (TW)

( * ) Notice: Subject to any disclaimer, the term of this patent is extended or adjusted under 35 U.S.C. 154(b) by 0 days.

(21) Appl. No.: 09/909,719

(22) Filed: Jul. 19, 2001

(51) Int. Cl.[7] ..... A44B 21/00; D06C 13/08
(52) U.S. Cl. ..... 28/161; 28/169
(58) Field of Search ..... 28/159, 160, 161, 28/169, 170, 217, 219; 26/2 R, 8 R; 24/442, 443, 445, 451; 139/391; 428/92, 96, 97, 100; 427/289, 290, 412, 413, 299, 314

(56) References Cited

U.S. PATENT DOCUMENTS 1,941,912 A * 1/1934 Repony ..... 28/169
2,590,713 A * 3/1952 Libbey ..... 28/169
3,461,513 A * 8/1969 Girard et al. ..... 28/161
3,490,107 A * 1/1970 Brumlik ..... 24/451
3,943,981 A * 3/1976 De Brabander ..... 28/161
3,974,312 A * 8/1976 Stevens et al. ..... 28/162
4,013,407 A * 3/1977 Ray, Jr. ..... 28/159
4,198,734 A * 4/1980 Brumlik ..... 24/451
4,490,433 A * 12/1984 Shigeru et al. ..... 427/393.1
4,541,154 A * 9/1985 Ito et al. ..... 24/442
5,985,406 A * 11/1999 Takizawa et al. ..... 24/451

* cited by examiner

*Primary Examiner*—Amy B. Vanatta
(74) *Attorney, Agent, or Firm*—Pro-Techtor International Services

(57) ABSTRACT

A hook tape fabrication method includes the steps of coating nylon yarns with a layer of water repellent, coating the repellent-coated nylon yarns thus obtained with a layer of PU rubber, weaving the nylon yarns thus obtained into loops, and cutting the loops into hooks.

27 Claims, 9 Drawing Sheets

HOOK TAPE FABRICATION METHOD

BACKGROUND OF THE INVENTION

The present invention relates to a VELCRO™ (magic) tapes and, more particularly, to a hook tape fabrication method, which is practical for the fabrication of hook tapes for use in devices for water sports.

Conventional male Velcro™ tapes, i.e., hook tapes are commonly made by: weaving nylon yarns into loops and then cutting the loops into hooks. Because nylon yarns have capillary tubes, they absorb water when dipped in water. When a hook tape is wetted, the hooks become softened, and the hooking power of the hooks is drastically dropped. It is dangerous to use these kinds of hook tapes in devices for water sports.

SUMMARY OF THE INVENTION

The present invention has been accomplished under the circumstances in view. It is the main object of the present invention to provide a hook tape fabrication method, which is practical for the fabrication of hook tapes for use in devices for water sports. According to one embodiment of the present invention, nylon yarns are coated with a layer of water repellent and then coated with a layer of PU (polyurethane) rubber, and the PU rubber-coated nylon yarns thus obtained are woven into loops and cut into hooks. The coating of water repellent protects the nylon yarn against water. The coating of PU rubber protects the nylon yarn against water pressure. According to an alternate form of the present invention, nylon yarns are woven into loops and then cut into hooks, and then the hooks thus obtained are coated with a layer of water repellent and then coated with a layer of PU rubber on the layer of water repellent.

DETAILED DESCRIPTION OF THE PREFERRED EMBODIMENT

Figure 1:
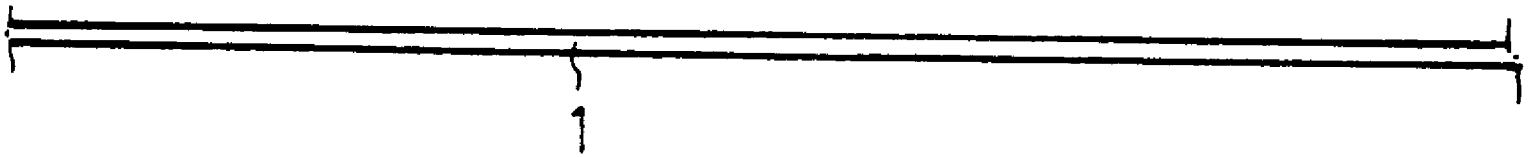
FIG. 1 illustrates a front view of a nylon yarn prepared according to a first embodiment of the present invention.
Figure 2:
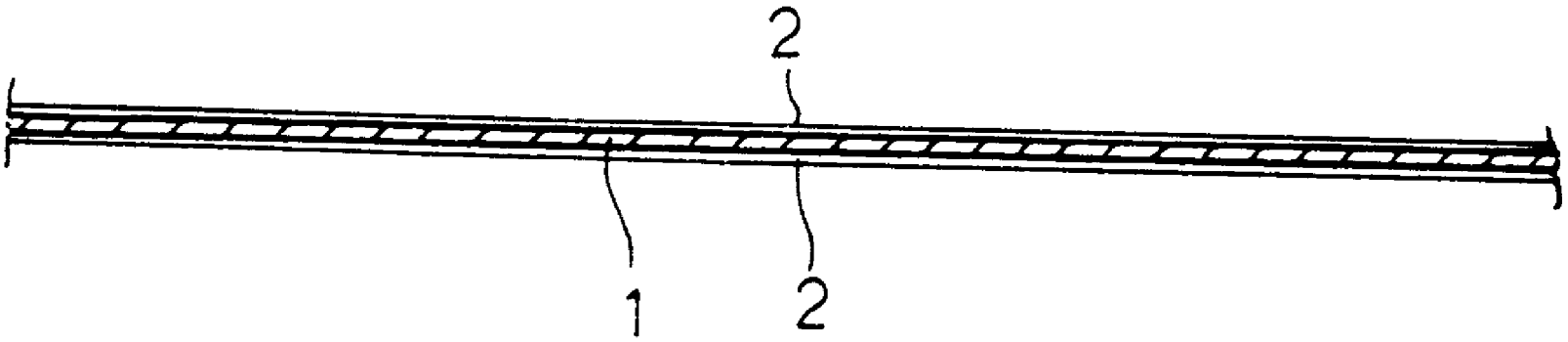
FIG. 2 illustrates the nylon yarn coated with a layer of water repellent according to the first embodiment of the present invention.
Figure 3:
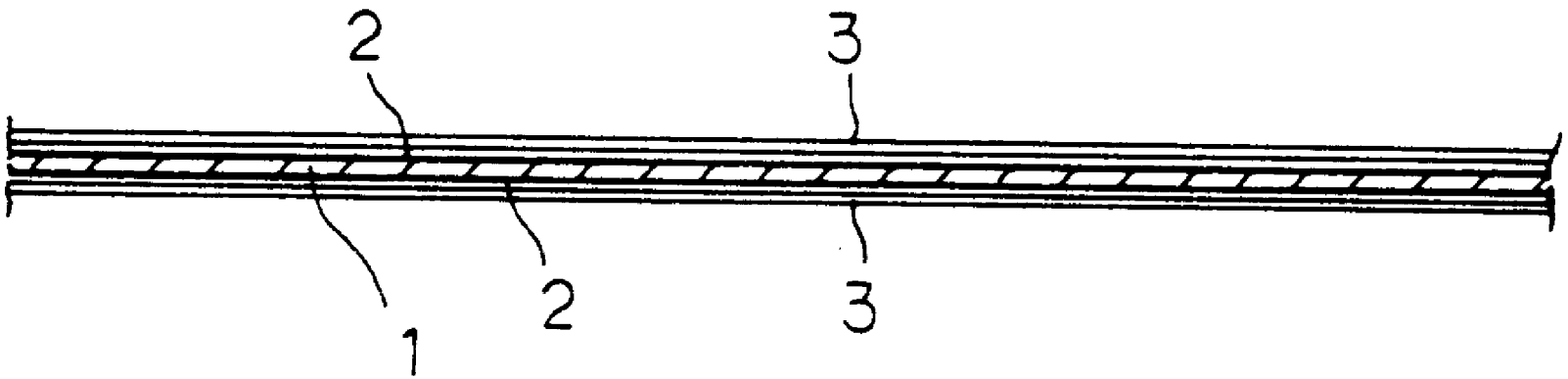
FIG. 3 illustrates the water repellent-coated nylon yarn coated with a layer of polyurethane rubber according to the first embodiment of the present invention.
Figure 4:
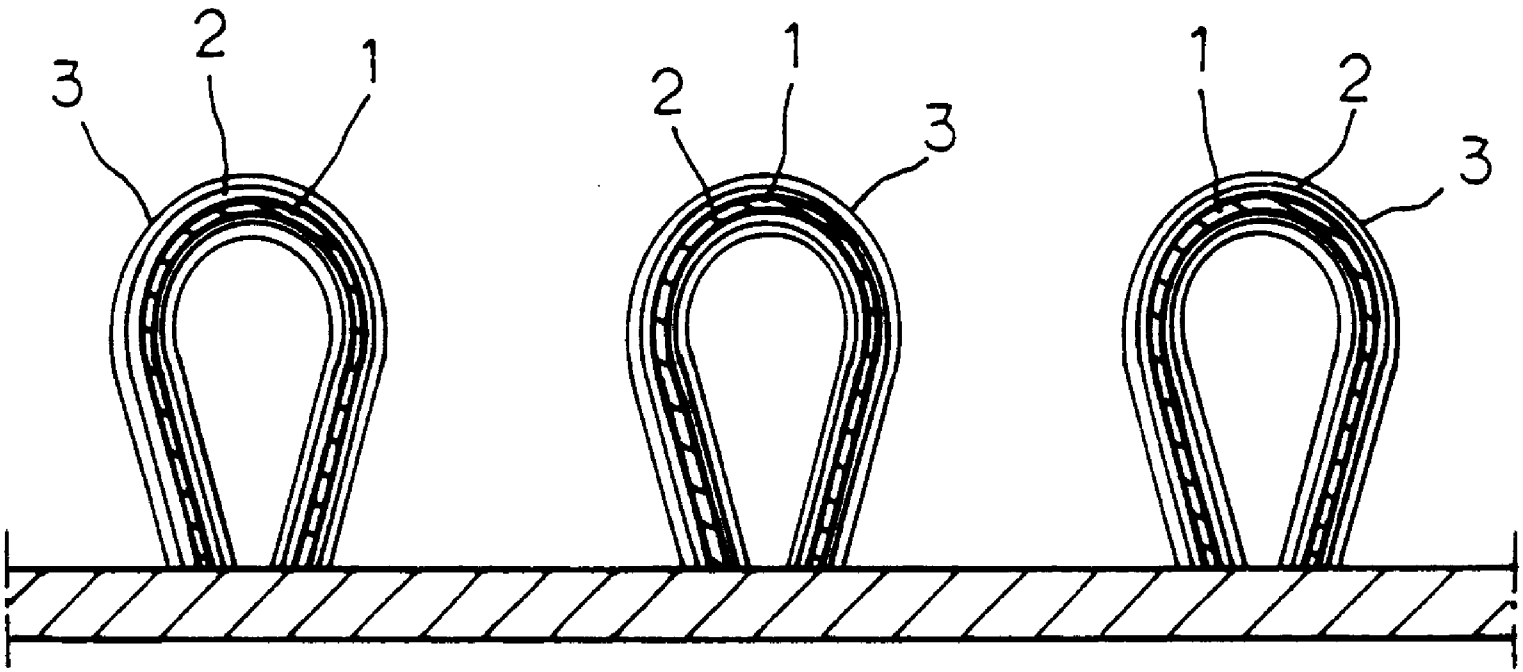
FIG. 4 illustrates the PU rubber coated nylon yarn woven into loops according to the first embodiment of the present invention.
Figure 5:
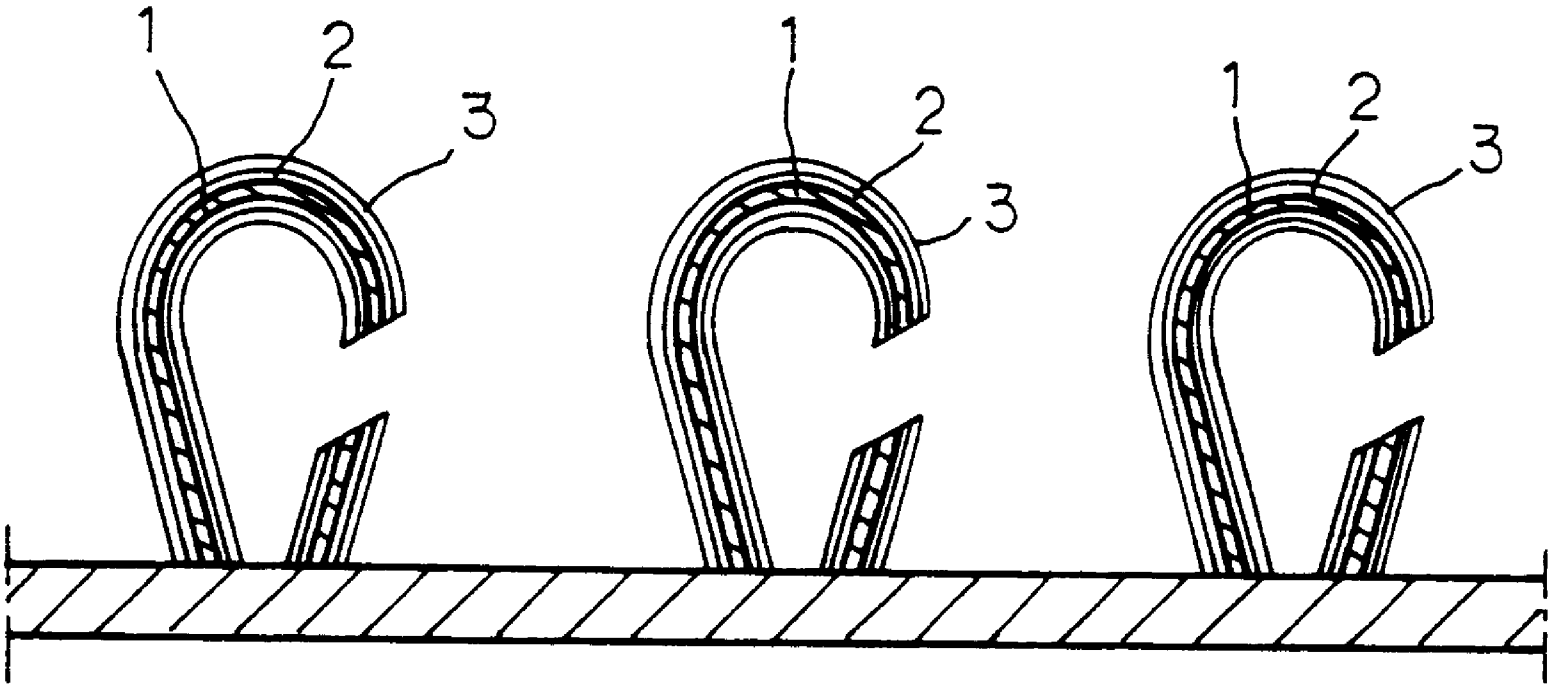
FIG. 5 illustrates the loops cut into hooks according to the first embodiment of the present invention.

Referring to FIGS. 1~4, a hook tape fabrication method according to a first embodiment of the present invention comprises the steps of:

(a) preparing nylon yarns 1 (see FIG. 1), and then coating prepared nylon yarns 1 with a layer of water repellent 2 and then drying the coating of water repellent 2 (see FIG. 2);

(b) coating the repellent-coated nylon yarns with a layer of rubber 3 (see FIG. 3);

(c) weaving the rubber-coated nylon yarns thus obtained into rows of loops (see FIG. 4); and (d) cutting the loops into hooks (see FIG. 5).

In the aforesaid fabrication procedure, the coating of water repellent protects the nylon yarn against water, and the coating of PU rubber protects the nylon yarn against water pressure.

Figure 6:
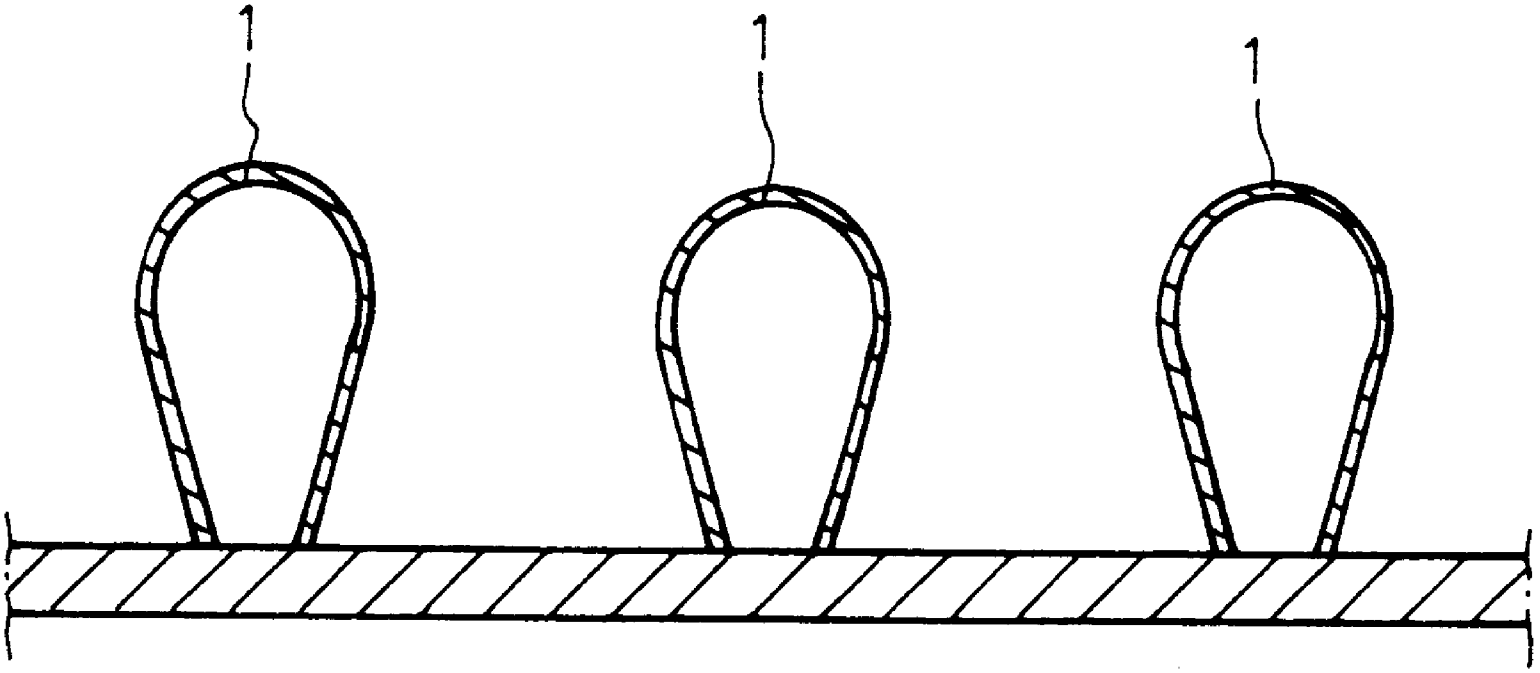
FIG. 6 illustrates nylon yarns woven into loops according to a second embodiment of the present invention.
Figure 7:
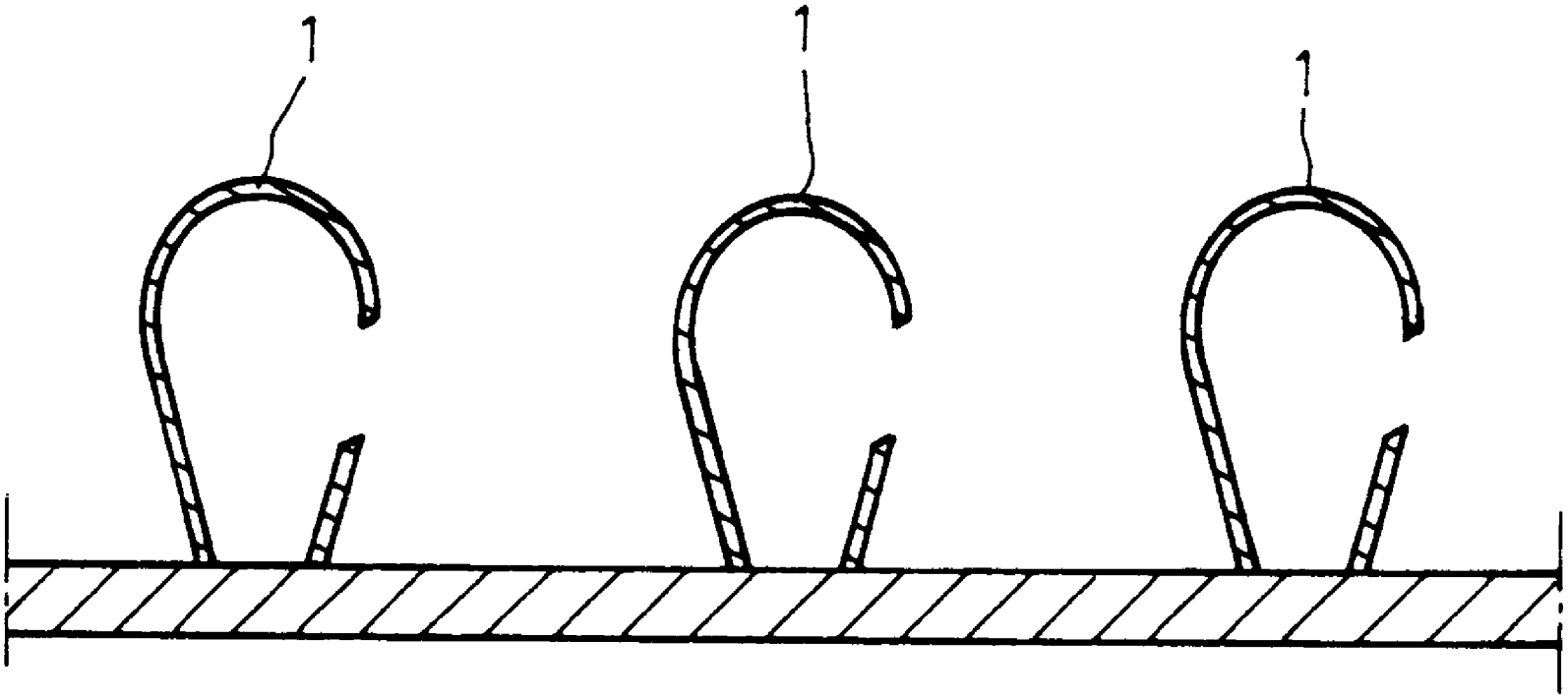
FIG. 7 illustrates the loops cut into hooks according to the second embodiment of the present invention.
Figure 8:
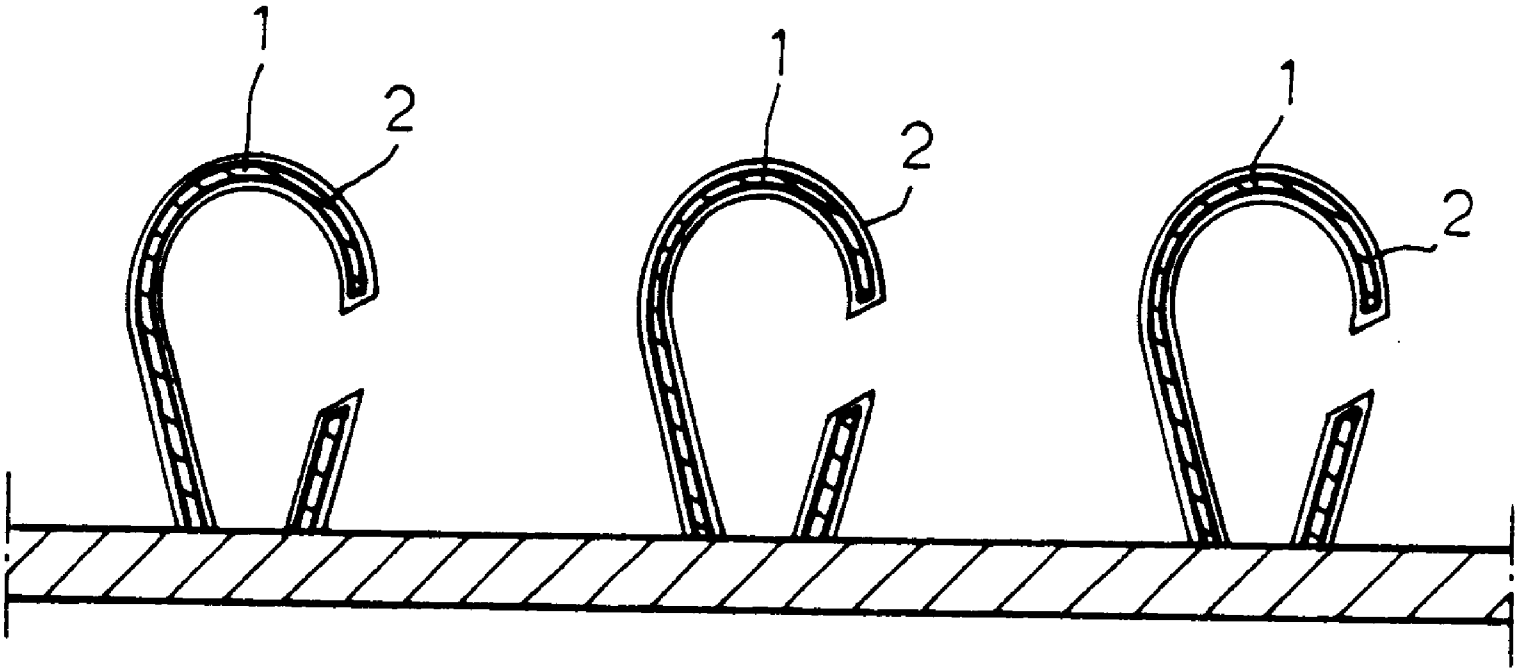
FIG. 8 illustrates the hooks coated with a layer of water repellent according to the second embodiment of the present invention.
Figure 9:
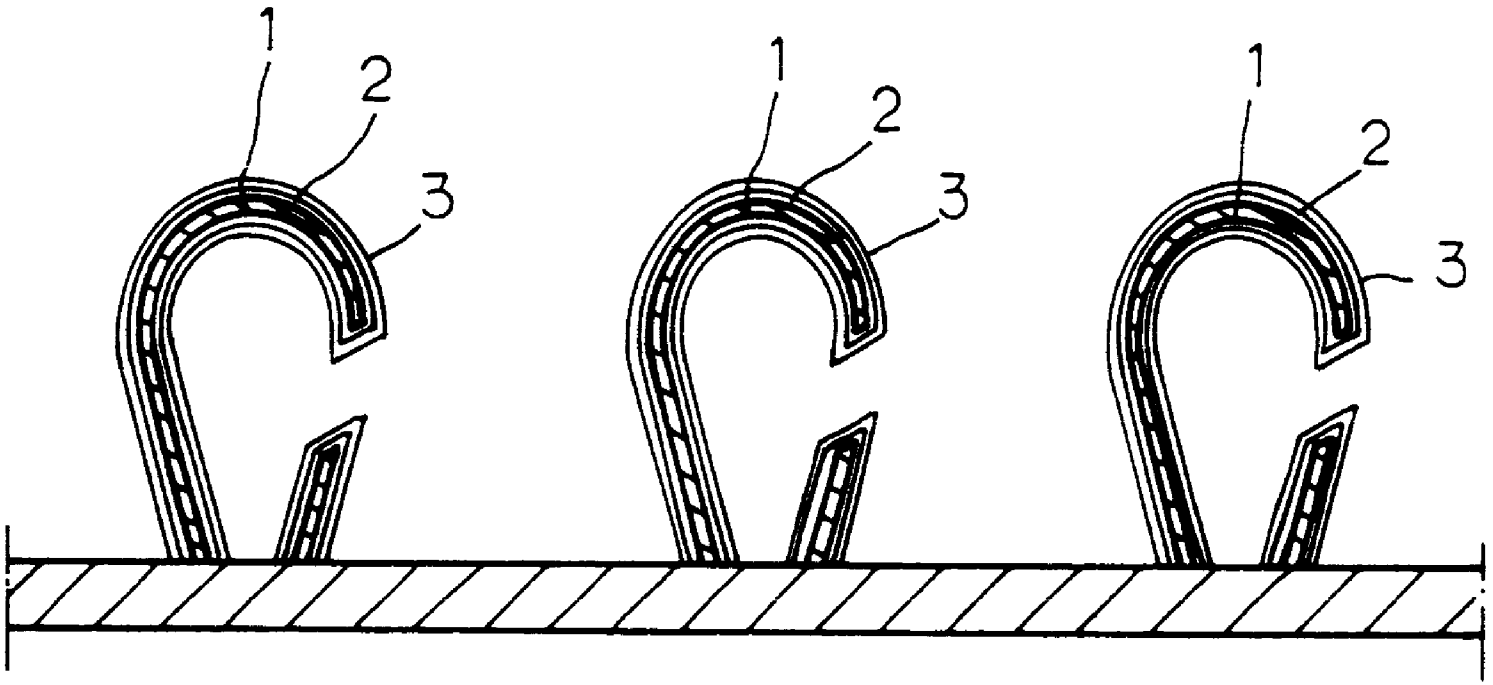
FIG. 9 illustrates the water repellent-coated hooks coated with a layer of PU rubber according to the second embodiment of the present invention.

Referring to FIGS. 6~9, hook tape fabrication method according to a second embodiment of the present invention comprises the steps of:

(a) preparing nylon yarns 1, and then weaving prepared nylon yarns into rows of loops (see FIG. 6);

(b) cutting the loops thus obtained into hooks (see FIG. 7);

(c) coating the hooks thus obtained with a layer of water repellent 2 and then drying the coating (see FIG. 8); and (d) coating the water repellent-coated hooks thus obtained with a layer of rubber 3 (see FIG. 9).

In the aforesaid second embodiment, the coating of water repellent 2 and rubber 3 can be directly applied to the nylon yarns after the nylon yarns have been woven into loops. Alternatively, the coating of water repellent 2 and rubber 3 can be applied to the nylon yarns after the nylon yarns have been woven into loops and cut into hooks.

In either of the aforesaid first and second embodiments, water repellent 2 and rubber 3 can be applied to nylon yarns by painting, spray-painting, dipping, or any of variety of equivalent methods. The aforesaid water repellent 2 is preferably obtained from fluororesin emulsion. The aforesaid rubber 3 is preferably obtained from PU (polyurethane). Further, the method of drying the coating of water repellent 2 and/or rubber 3 can be achieved by air-cooling, baking, UV (ultraviolet) radiation, or any of a variety of equivalent drying methods.

A hook tape made according to the present invention provides high hooking power and waterproof property. When wetted, the hooking power of the hook tape still maintained intact. Therefore, the invention is suitable for use in the fabrication of devices for water sports.

A prototype of hook tape fabrication method has been constructed with the features of FIGS. 1~9. The hook ape fabrication method functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A hook tape fabrication method comprising the steps of:

(a) preparing nylon yarns, and then coating prepared nylon yarns with a layer of water repellent and then drying the coating of water repellent;

(b) coating the repellent-coated nylon yarns thus obtained with a layer of rubber;

(c) weaving the rubber-coated nylon yarns thus obtained into rows of loops; and (d) cutting the loops thus obtained into hooks.

2. The hook tape fabrication method of claim 1 wherein said water repellent is obtained from fluororesin emulsion.

3. The hook tape fabrication method of claim 1 wherein said rubber is obtained from polyurethane.

4. The hook tape fabrication method of claim 1 wherein the procedure of drying the coating of water repellent is achieved by air-cooling.

5. The hook tape fabrication method of claim 1 wherein the procedure of drying the coating of water repellent is achieved by baking.

6. The hook tape fabrication method of claim 1 wherein the procedure of drying the coating of water repellent is achieved by ultraviolet radiation.

7. The hook tape fabrication method of claim 1 wherein the coating of said water repellent is achieved by painting.

8. The hook tape fabrication method of claim 1 wherein the coating of said water repellent is achieved by spray-painting.

9. The hook tape fabrication method of claim 1 wherein the coating of said water repellent is achieved by dipping.

10. A hook tape fabrication method comprising the steps of:

(a) preparing nylon yarns, and then weaving prepared nylon yarns into rows of loops;

(b) cutting the loops thus obtained into hooks;

(c) coating the hooks thus obtained with a layer of water repellent and then drying the coating of water repellent; and (d) coating the water repellent-coated hooks thus obtained with a layer of rubber.

11. The hook tape fabrication method of claim 10 wherein said water repellent is obtained from fluororesin emulsion.

12. The hook tape fabrication method of claim 10 wherein said rubber is obtained from polyurethane.

13. The hook tape fabrication method of claim 10 wherein the procedure of drying the coating of water repellent is achieved by air-cooling.

14. The hook tape fabrication method of claim 10 wherein the procedure of drying the coating of water repellent is achieved by baking.

15. The hook tape fabrication method of claim 10 wherein the procedure of drying the coating of water repellent is achieved by ultraviolet radiation.

16. The hook tape fabrication method of claim 10 wherein the coating of said water repellent is achieved by painting.

17. The hook tape fabrication method of claim 10 wherein the coating of said water repellent is achieved by spray-painting.

18. The hook tape fabrication method of claim 10 wherein the coating of said water repellent is achieved by dipping.

19. A hook tape fabrication method comprising the steps of:

(a) preparing nylon yarns, and then weaving prepared nylon yarns into rows of loops;

(b) coating the loops thus obtained with a layer of water repellent and then drying the coating of water repellent;

(c) cutting the water repellent-coated loops thus obtained into hooks; and (d) coating the water repellent-coated hooks thus obtained with a layer of rubber.

20. The hook tape fabrication method of claim 19 wherein said water repellent is obtained from fluororesin emulsion.

21. The hook tape fabrication method of claim 19 wherein said rubber is obtained from polyurethane.

22. The hook tape fabrication method of claim 19 wherein the procedure of drying the coating of water repellent is achieved by air-cooling.

23. The hook tape fabrication method of claim 19 wherein the procedure of drying the coating of water repellent is achieved by baking.

24. The hook tape fabrication method of claim 19 wherein the procedure of drying the coating of water repellent is achieved by ultraviolet radiation.

25. The hook tape fabrication method of claim 19 wherein the coating of said water repellent is achieved by painting.

26. The hook tape fabrication method of claim 19 wherein the coating of said water repellent is achieved by spray-painting.

27. The hook tape fabrication method of claim 19 wherein the coating of said water repellent is achieved by dipping.

* * * * *